United States Patent [19]

Harang et al.

[11] 4,171,247

[45] Oct. 16, 1979

[54] METHOD FOR PREPARING ACTIVE CATHODES FOR ELECTROCHEMICAL PROCESSES

[75] Inventors: Hakon Harang, Gjettum; Karl Widding, Oslo; Knut A. Andreassen, Porsgrunn; Johan B. Holte, Blommenholm, all of Norway

[73] Assignee: Norsk Hydro a.s., Norway

[21] Appl. No.: 881,052

[22] Filed: Feb. 24, 1978

[30] Foreign Application Priority Data

Feb. 24, 1977 [NO] Norway ..... 770616

[51] Int. Cl.[2] ..... C25D 5/36; C25D 5/40

[52] U.S. Cl. ..... 204/34; 204/32 R; 204/43 T; 204/49; 204/129; 204/290 R; 204/293

[58] Field of Search ..... 204/34, 293, 49, 32 R, 204/43 T, 129, 290 R

[56] References Cited

U.S. PATENT DOCUMENTS 1,818,579 8/1931 Pfleiderer ..... 204/293 X

FOREIGN PATENT DOCUMENTS 818639 10/1951 Fed. Rep. of Germany .
2620589 11/1976 Fed. Rep. of Germany .
44684 12/1927 Norway .

*Primary Examiner*—G. L. Kaplan
*Attorney, Agent, or Firm*—Wenderoth, Lind & Ponack

[57] ABSTRACT

Improved active cathodes, prepared by cleaning and etching with nitric acid and activated by a galvanic coating in a bath containing a nickel salt and sulphur liberating component, are provided. The improvement resides in controlled etching and activation conditions.

5 Claims, No Drawings

METHOD FOR PREPARING ACTIVE CATHODES FOR ELECTROCHEMICAL PROCESSES

The present invention relates to a method for preparing active cathodes for electrochemical processes, particularly for electrochemical production of hydrogen. The cathodes are activated by depositing a nickel coating containing sulphur. The coating is made by cathodic deposition from an aqueous electrolyte solution containing nickel salt, buffer and a sulphur liberating component. Before coating, the cathode is conventionally cleaned and etched by nitric acid.

Several methods of activating electrodes in order to reduce the overvoltage are already known. One of these methods comprises deposition of a sulphur containing nickel coating on the cathode. Norwegian Pat. No. 44 684 describes such a coating in which thiosulphate is used as the sulphur-liberating component. The patent gives no information about how much sulphur the coating should contain in order to give the best effect, nor does it mention pretreatment of the cathode. This method has been tried out, and no reduction of the overvoltage was obtained. Furthermore, such coating does not have the required mechanical properties as it tends to scale off after some time and is also so britle that bending the electrode will crack it.

German Pat. No. 818 639 also describes preparation of cathodes with a sulphur containing nickel coating. This can be done by first sintering iron powder to the cathode plate of, for instance, nickel and then covering this with a nickel sulfide coating either by melting or galvanic deposition. The coating is stated to be $Ni_3S_2$ which stoichomtrically contains 26.7% sulphur. The sulphur liberating component used in the galvanic deposition is not stated. Sintering of iron is used because sandblowing only of the cathodes before coating has not given sufficient adherence between the cathode and the coating. This method is considered too laborious and expensive. Additionally the coating does not seem to give less overvoltage than the above-mentioned Norwegian patent.

Pre-treatment of electrodes is not widely described in the patent literature, but in German laid open patent application No. 2.620.589 there is mentioned the fact that the base material can be sandblown or etched in order to remove oxide films and to obtain a rough surface. The etching should preferably be performed in a 10% solution of oxalic acid for at least 3 hours, whereupon the electrode is dipped in degassed water. The etching agent is not critical and among several possible etching agents mentioned is nitric acid. The etching conditions are, however, not specified.

The object of the present invention was to arrive at an improved cathode with a low overvoltage. A further objective was to coat the cathode with a coating which was active for a longer period than previously known coatings, and which adhered better to the base material and had better mechanical properties than the known coatings.

During the development of improved activated cathodes it soon became clear that pre-treatment of the cathode before coating was important, and different methods of pre-treating were studied. Surprisingly it was found that a special pretreatment produced both better adherence to the base material and a form of the coating which made it more active.

Contrary to that stated in the German laid open patent application No. 2.620.589 were sandblowing and etching are said to be equal, it was found that etching gave a sharper, more sandpaperlike surface than sandblowing. Further it was found that etching should be done in nitric acid with a relatively well defined strength in order to give the sharpest possible surface. While the above mentioned German patent application demands at least 3 hours of etching in oxalic acid, it was found that etching in nitric acid of suitable concentration could be carried out within far shorter time. Also the temperature during the etching proved to be of some importance to the roughness of the surface. Before the deposition of the active coating, the cathode plate, with base material normally of steel, was given a thin nickel coating.

Several sulphurliberating components were studied in order to arrive at a more active coating. During this research it was surprisingly found that thiourea gave a more active coating than thiosulphate. The importance of the amount of sulphur in the coating to the activity of the coating was also studied. Though coatings with a sulphur content of 4–40% resulted in low overvoltage, it was found that in the present method the best coating was obtained when the coating process produced a coating with 13–18% sulphur.

Activation of the cathode according to the present invention was carried out as stated in the patent claims.

In order to study the influence of the different parameters on the sulphur content and activity of the coating some preliminary tests were performed.

By the "activity" of the cathode is meant in the present application the reduction of hydrogen voltage after an operating period of about 5 months in a water decomposing cell having 25% potassium hydroxide solution as the electrolyte. The temperature should be 80° C. and the cathodic current density 10 A/dm$^2$. Unactivated steel cathodes are used as reference.

The sulphur content of the active coatings as a function of current density was studied using constant values for nickel sulphate (250 g/l), thiourea (100 g/l), pH (4) and bath temperature (50° C). It was found that the sulphur content decreased slowly by increasing cathodic current density. Current densities 0.3–6 A/dm$^2$ resulted in acceptable results, and 2–3 A/dm$^2$ seemed to the optimal in order to obtain a sulphur content of 14–15% in the coating.

Effect of the content of thiourea in the bath

| | | |
|---|---|---|
| Constant conditions: | | |
| Concentration of nickel sulphate | $NiSO_4 . 7H_2O$ | 50 g/l |
| Concentration of buffer | $CH_3COOH$ | 4 g/l |
| | NaOH | 2 g/l |
| pH of the bath | 4 | |
| Temperature of the bath | 40° C. | |
| Cathodic current density | 0.5 A/dm$^2$ | |
| Duration of electrolysis | 3 hours | |

| Concentration of thiourea $CS(NH_2)_2$ g/l | The coating's content of sulphur | Activity of cathode expressed in mV reduced voltage |
|---|---|---|
| 10 | 8.5 | 100 |
| 100 | 13.5 | 150 |
| 200 | 16.1 | 180 |

Variation of the content of nickel sulphate in the bath has little influence on the sulphur content of the coating and the cathode's activity within the concentration range 50–350 g/l. The best coatings, from a mechanical point of view, seemed to be obtained in a bath with a 100–250 g/l nickel sulphate hydrate.

The influence of bath temperature within the range of 30° C.–60° C. was studied and the whole of this range was found applicable. The temperature range of 40°–50° C. seemed to be the most suitable.

The pH of the bath was studied under constant conditions for the other parameters and acceptable results were obtained for pH 3–6. However, it was found that the pH of the bath preferably should be kept at about 4.

EXAMPLE 1

The cathode plates were, after a possible degreasing, dipped in a bath containing nitric acid of about 15% strength. At start-up the temperature in the bath was about 25° C., but increased rapidly. The etching bath was provided with cooling means and the temperature during the etching was kept at about 40° C. After etching for 6–8 minutes, the cathodes were taken up from the bath and rinsed with water.

The cathodes were then given a thin coating of nickel as base for the active coating and for corrosion protection.

After pre-treatment the cathodes were transferred to an activation bath with the following composition:

| | |
|---|---|
| $NiSO_4 . 7H_2O$ | 60 g/l |
| $CS(NH_2)_2$ | 80 g/l |
| $CH_3COOH$ | 4.5 g/l |
| NaOH | 2 g/l |
| pH of the bath | 3.5 |
| Temperature | 60° C. |
| Cathodic current density | 0.6 A/dm$^2$ |
| Duration of electrolysis | 7½ hour |

Air was blown through the bath in order to give the necessary agitation. 5.1 g coating containing 15% sulphur and 85% nickel was deposited per dm$^2$.

The active electrode was used as cathode in a water decomposing cell with 25% potassium hydroxide solution as the electrolyte. The temperature was 80° C. and the current density 10 A/dm$^2$. During continuous operation for 4 months a hydrogen overvoltage of 90–100 mV was measured.

EXAMPLE 2

The cathodes were pre-treated as stated in example 1 and thereupon given an active coating in a bath with the following composition:

| | |
|---|---|
| $NiSO_4 . 7H_2O$ | 80 g/l |
| $CS(NH_2)_2$ | 100 g/l |
| $CH_3COOH$ | 4 g/l |
| NaOH | 2 g/l |
| pH of the bath | 3.7 |
| Temperature | 40° C. |
| Cathodic current density | 0.8 A/dm$^2$ |
| Duration of electrolysis | 7½ hour |

Deposited coating was 7 g/dm$^2$ and contained 15.5% sulphur and 84.5% nickel.

During application of these activated cathodes for 8 months hydrogen overvoltages of 60–110 mV was measured.

EXAMPLE 3

The cathodes were pre-treated as stated in example 1 and given an active coating in a bath with the followng composition:

| | |
|---|---|
| $NiSO_4 . 7H_2O$ | 250 g/l |
| $CS(NH_2)_2$ | 50 g/l |
| $H_3BO_3$ | 40 g/l |
| NaCl | 20 g/l |
| pH of the bath | 4 |
| Temperature | 50° C. |
| Cathodic current density | 2 A/dm$^2$ |
| Duration of electrolysis | 2 hours |

It was deposited 5.1 g coating per dm$^2$ and it contained 14.3% sulphur and 85.7% nickel.

During application of these activated cathodes for 8 months hydrogen overvoltages of 60–120 mV was measured.

EXAMPLE 4

The cathodes were pre-treated as in the previous examples and given an active coating in a bath with the following composition:

| | |
|---|---|
| $NiSO_4 . 7H_2O$ | 100 g/l |
| $CS(NH_2)_2$ | 120 g/l |
| $H_3BO_3$ | 40 g/l |
| NaCl | 20 g/l |
| pH of the bath | 4 |
| Temperature | 45° C. |
| Cathodic current density | 1 A/dm$^2$ |
| Duration of electrolysis | 4 hours |

It was deposited 5 g coating per dm$^2$ and it contained 16% sulphur and 84% nickel.

During application of these activated cathodes for 8 months hydrogen overvoltages of 70–120 mV was measured.

EXAMPLE 5

The cathodes were pre-treated as in the previous examples and given an active coating in a bath with the following composition:

| | |
|---|---|
| $NiSO_4 . 7H_2O$ | 200 g/l |
| $CS(NH_2)_2$ | 100 g/l |
| $H_3BO_3$ | 40 g/l |
| NaCl | 20 g/l |
| pH of the bath | 4 |
| Temperature | 45° C. |
| Cathodic current density | 3 A/dm$^2$ |
| Duration of electrolysis | 80 minutes |

It was deposited 5 g coating per dm$^2$ and it contained 14% sulphur and 86% nickel.

During application of these activated cathodes for 8 months hydrogen overvoltages measured as being 50–100 mV.

The cathodes according to the invention have also been tested in alkali chloride diaphragm cells where hydrogen overvoltage was measured as being 50–120 mV compared to 300 mV for steel cathodes.

Cathodes according to the present invention were prepared as shown in the above examples, and have been applied inter alia in technical water decomposing cells for several months. They have proved to retain their activity during the complete test period. The coatings have also proved to have better mechanical properties than known sulphur-containing coatings, they do not peel off during operation and endured well the mechanical stress to which they were exposed during transportation, assembling etc.

The hydrogen overvoltage of the cathodes according to the invention is also lower than for cathodes coated in a bath with thiosulphate. Thus it hydrogen overvoltage of 50–120 mV compared to 110–150 mV for the known cathodes have been measured. As a reduction of the operating voltage of a water decomposing cell with for instance 0.2 V will result in a energy reduction of about 10%, it is evident that even small reductions in hydrogen overvoltage is of great importance.

Another advantage of the present invention is that the cost of activation is substantially lower than by other activation methods, for instance activation by noble metal coatings. Further the present method can be performed under reliable conditions and the regulation of the conditions is relatively easy.

In sum, the present method provides improved active cathodes wherein:

(a) the etching of the cathode is performed within 5–10 minutes in a nitric acid solution with a concentration of 10–25%;

(b) the temperature is kept at 35°–45° C. during the etching;

(c) the cathode is activated in a bath with 50–350 g/l nickel sulphate-hydrate, 10–200 g/l thiourea; and (d) the temperature is kept at 30°–60° C. and the pH is kept at 3–6, while the activation is performed during application of a cathodic current density of 0.3–6 A/dm$^2$.

The activation of the cathode may be desirably performed in a bath with 200–250 g/l nickel sulphate-hydrate, 50–150 g/l thiourea, pH of 4, temperature of 45°–50° C., and applying a cathodic current density of 2–3 A/dm$^2$ while the activation is performed for 1–2 hours or in a bath having 60–100 g/l nickel sulphate-hydrate, 80–120 g/l thiourea, pH of 3.5–4, temperature of 40°–45° C., and applying cathodic current density of 0.5–1.5 A/dm$^2$ while the activation is performed for 4–8 hours.

The etching may be desirably performed in 15% nitric acid solution at 36°–39° C. for a period of 6–8 minutes.

We claim:

1. In a method for the preparation of active cathodes suitable for electrolysis for water wherein the cathode substrate is cleaned and etched in nitric acid and is then activated by galvanic coating in a bath containing a nickel salt and a sulphur liberating component, the improvement wherein:

(a) the etching of the cathode is performed within 5–10 minutes in a nitric acid solution with a concentration of 10–25%;

(b) the temperature is kept at 35°–45° C. during the etching;

(c) the cathode is activated in a bath with 50–350 g/l nickel sulphate-hydrate, 10–200 g/l thiourea; and (d) the temperature is kept at 30°–60° C. and the pH is kept at 3–6, while the activation is performed during application of a cathodic current density of 0.3–6 A/dm$^2$.

2. The method according to claim 1, wherein said improvement further comprises performing the activation of the cathode in a bath with 200–250 g/l nickel sulphate-hydrate, 50–150 g/l thiourea, pH of 4, temperature of 45°–50° C., and applying a cathodic current density of 2–3 A/dm$^2$ while the activation is performed for 1–2 hours.

3. The method according to claim 1, wherein said improvement further comprises performing the activation of the cathode in a bath having 60–100 g/l nickel sulphate-hydrate, 80–120 g/l thiourea, pH of 3.5–4, temperature of 40°–45° C., and applying a cathodic current density of 0.5–1.5 A/dm$^2$ while the activation is performed for 4–8 hours.

4. The method according to claims 1, 2 or 3 wherein said improvement further comprises performing the etching of the cathode in a 15% nitric acid solution at 36°–39° C. for a period of 6–8 minutes.

5. The method according to claim 1 wherein the substrate is nickel or steel with or without a nickel coating.

* * * * *